US006286261B1

(12) United States Patent
Hackstock

(10) Patent No.: US 6,286,261 B1
(45) Date of Patent: Sep. 11, 2001

(54) VEHICLE SLIDING DOOR TRACK AND GUIDE ELEMENTS

(76) Inventor: Gerald Alan Hackstock, 6870 Holland, Clay Township, MI (US) 48001

( * ) Notice: Subject to any disclaimer, the term of this patent is extended or adjusted under 35 U.S.C. 154(b) by 0 days.

(21) Appl. No.: 09/375,731

(22) Filed: Aug. 17, 1999

(51) Int. Cl.[7] ..... E05D 15/10
(52) U.S. Cl. ..... 49/216; 49/213; 49/211
(58) Field of Search ..... 49/209, 211, 213, 49/214, 215, 216, 221, 223; 16/91, 95 R, 87 R, 87.4 R

(56) References Cited

U.S. PATENT DOCUMENTS

| | | | |
|---|---|---|---|
| 728,657 | | 5/1903 | Beatty . |
| 873,230 | | 12/1907 | Harris . |
| 1,075,622 | | 10/1913 | Beers . |
| 1,124,033 | | 1/1915 | Lake . |
| 1,883,149 | | 10/1932 | Wasberg et al. . |
| 1,958,945 | | 5/1934 | Foss . |
| 2,731,220 | | 1/1956 | Power . |
| 3,242,535 | | 3/1966 | Ferris . |
| 3,481,078 | | 12/1969 | Ferris . |
| 4,152,872 | * | 5/1979 | Tanizaki et al. ..... 49/223 X |
| 4,418,498 | | 12/1983 | Wanlase et al. . |
| 4,559,740 | * | 12/1985 | Tuchiya et al. ..... 49/216 |
| 4,573,286 | * | 3/1986 | Favrel et al. ..... 49/214 |
| 5,832,668 | | 11/1998 | Faubert et al. . |
| 5,906,071 | * | 5/1999 | Buchanan ..... 49/214 X |

* cited by examiner

*Primary Examiner*—Jerry Redman
(74) *Attorney, Agent, or Firm*—Young & Basile, P.C.

(57) ABSTRACT

In a sliding door for a vehicle having an opening in at least one side thereof, the sliding door is connected to the vehicle for non-linear movement along a fixed path between an open position and a closed position with respect to the opening. The fixed path is defined by an upper guide track, a lower guide track, and an intermediate guide track. Each elongate guide track has an identical generally C-shaped cross-section with an elongate slot opening through a lower surface. At least one guide member is engagable within each track for guiding the sliding door while moving in either direction between the open position and the closed position with respect to the opening in the vehicle. Preferably, at least one load bearing roller is provided on each door mounting bracket, or at least two load bearing rollers are provided on two of the three door mounting brackets.

19 Claims, 3 Drawing Sheets

VEHICLE SLIDING DOOR TRACK AND GUIDE ELEMENTS

FIELD OF THE INVENTION

The invention relates to a van type vehicle sliding door assembly, and more particularly to a track and guide assembly to allow for movement for a sliding door between a first position along a fixed non-linear path wherein the sliding door is generally parallel to and adjacent to a side of a vehicle, and a second position wherein the sliding door closes an opening in a side of the vehicle and generally lies flush with the side of the vehicle.

BACKGROUND OF THE INVENTION

Van type vehicles typically include sliding door assemblies with a bracket mounted on the door supporting a plurality of cylindrical rollers having axes of rotation disposed either parallel to one another and/or normal to one another to support the door in the vertical and horizontal directions. Typically, the sliding door is guided along a non-linear fixed path of travel between an open position and a closed position along an upper track, an intermediate track, and a lower track. The different relative positions of the track with respect to the door typically requires each track to have a unique cross sectional configuration, and requires a specific bracket and roller assembly for engagement with the particular track. Typically, a conventional bracket includes two rollers rotatably mounted about a vertical axis of rotation and a support roller mounted about a horizontal axis of rotation. These rollers engage a track disposed horizontally along the vehicle and allows the door to be moved between the open position and closed position.

The track is required to be curved inwardly toward the vehicle center along the terminus to allow the door to be closed as the rollers supported by the bracket follow the track to cause the trailing edge of the door to sealingly engage the corresponding periphery of the opening. Typically, the rollers are small in diameter to allow the rollers to negotiate the curve in the track. The current requirement of different cross sectional configurations for the upper, intermediate, and lower tracks, as well as the added requirement of different brackets and rollers for each track configuration, unnecessarily complicates the assembly requirements in the assembly plant. In addition, each part requires a significant amount of storage space in the assembly facility, as well as any repair facility for the vehicles.

SUMMARY OF THE INVENTION

It would be desirable to provide a vehicle sliding door system having a track configuration, where each track is identical in cross-section to the other tracks. It would also be desirable in the present invention to provide a sliding door configuration where the bracket for the sliding door supported at least one roller having a semi-spherical surface for supporting the door in both the vertical and horizontal directions. It would be desirable in the present invention to provide a support bracket for the sliding door having at least one slide with a semi-spherical surface for supporting the sliding door in both vertical and horizontal directions. It would be desirable in the present invention to provide a vehicle sliding door system that included a bracket supporting at least one roller, or at least one slide, or a combination of at least one roller and at least one slide.

The present invention is for use in a sliding door system for a vehicle having an opening in at least one side thereof.

The sliding door is connected to the vehicle for non-linear movement along a fixed path of travel between an open position and a closed position with respect to the opening. The fixed path is defined by an upper guide track, a lower guide track, and an intermediate guide track. According to the present invention, each elongate guide track has an identical generally C-shaped cross-section with an elongate slot opening through a lower surface. At least one guide member is engageable within each track for guiding the sliding door while moving between the open position and the closed position with respect to the opening in the side of the vehicle.

The guide member can include at least one roller engagable within each track, where each of the rollers has a track-engaging surface in rolling contact with an interior surface of the track. Alternatively, or additionally, the guide member can include at least one slide engagable within each track, where each slide has a track-engaging surface in sliding contact with an interior surface of the track.

The present invention discloses an apparatus for suspending and guiding a moveable door panel through a non-linear path for opening and closing an opening in a motor vehicle. The present invention includes a bracket connectible to the moveable door panel. At least one elongate non-linear track is connectible to the motor vehicle. The track has a generally C-shaped cross-section with an elongate slot opening downwardly through the track. The track has first and second guide-engaging surfaces on inner surfaces of the track with the elongate slot disposed between the first and second guide-engaging surfaces. At least one guide element is attached to the moveable door panel by the bracket. The guide element is operable in cooperating engagement with a first and second guide-engaging surfaces of the elongate track.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
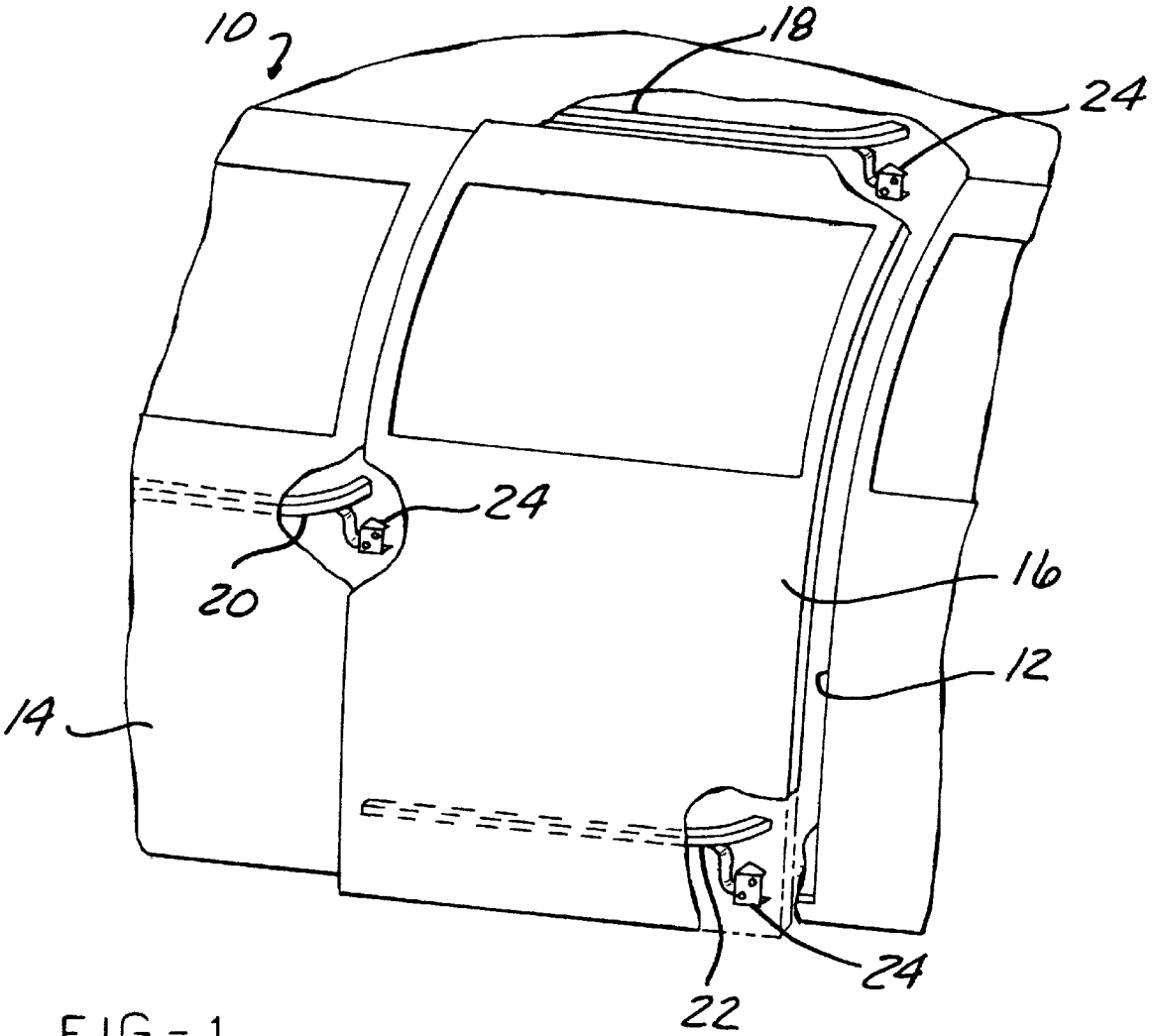
FIG. 1 is a partial side view of a van-type vehicle with a sliding door assembly according to the present invention.

The present invention is adapted for use in a vehicle 10 having an opening 12 in at least one side 14. A sliding door 16 is connected to the vehicle 10 for non-linear movement along a fixed path between an open position and a closed position with respect to the opening 12. The fixed path is defined by an upper guide track 18, an intermediate guide track 20, and a lower guide track 22. A bracket 24 is connectible to the moveable door panel or sliding door 16 to connect the sliding door 16 to the tracks 18, 20, and 22. The elongate non-linear tracks 18, 20, 22 are supported by the body and frame of the vehicle 10.

Each elongate guide track 18, 20, 22 has an identical generally C-shaped cross-section 26 as best seen in FIGS. 4–7. An elongate slot 28 is provided opening through a lower surface of the generally C-shaped cross-section 26 of tracks 18, 20, 22. At least one guide member 30 is engagable within each track 18, 20, 22 for guiding the sliding door 16 while moving between the open position and the closed position with respect to the opening 12 in the vehicle 10. At least one guide member 30 is attached to the moveable door panel or sliding door 16 by the bracket 24. The guide member 30 is operable in cooperating engagement with the elongate tracks 18, 20, 22 for guiding movement of the sliding door 16 between the open position and the closed position with respect to the opening 12 in the vehicle 10. Preferably, each track 18, 20, 22 has first and second guide-engaging surfaces 32, 34 on inner surfaces of the tracks 18, 20, 22 with the elongate slot 28 disposed between the first and second guide-engaging surfaces 32, 34. The weight of the sliding door 16 maintains the guide member 30 in contact with the angled or curved interior surfaces forming the first and second guide-engaging surfaces 32, 34. The other surfaces of the tracks 18, 20, 22 can be angled, curved, or straight as required for the application and method of manufacture.

Figure 4:
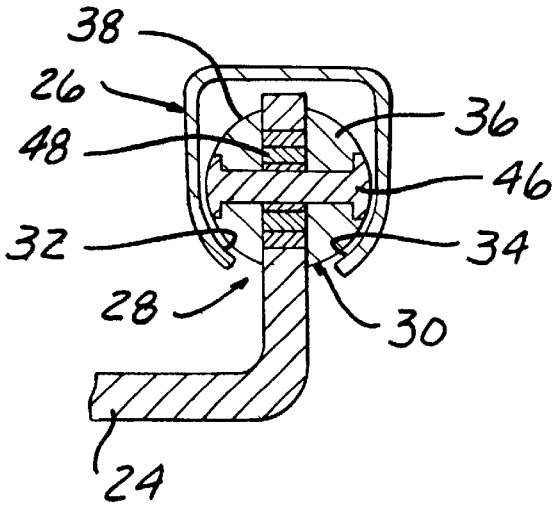
FIG. 4 is a cross-sectional view of a guide member including a roller engagable with an interior surface of the track according to the present invention.

The guide member 30 can include at least one load bearing roller 36 engageable within each track 18, 20, 22 as illustrated in FIG. 4. Each roller 36 includes a track-engaging surface 38 in rolling contact with an interior surface of the corresponding track 18, 20, 22, such as first and second guide-engaging surfaces 32, 34 on the interior of each track. Each roller 36 includes a horizontal axis of rotation transverse to a longitudinal axis of the corresponding elongate track 18, 20, 22. The roller 36 preferably has a semi-spherical or spherical surfaces in rolling contact with the guide-engaging surfaces 32, 34. The roller 36 can be formed in one or more parts connected to the bracket 24 and can include a pin 46 and bearing 48 defining the horizontal axis of rotation.

Figure 2:
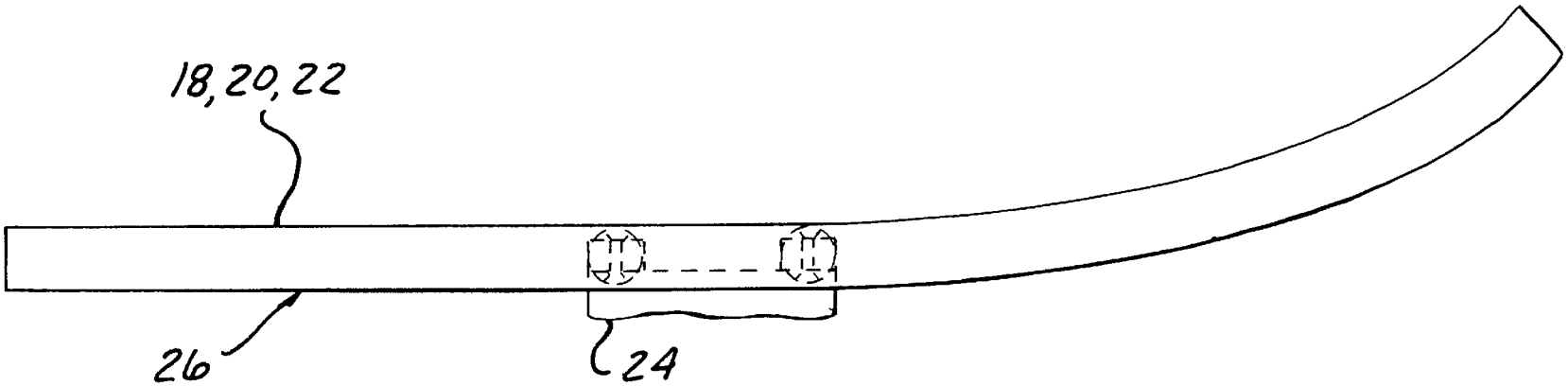
FIG. 2 is a plan view of a track and guide assembly according to the present invention.
Figure 3:
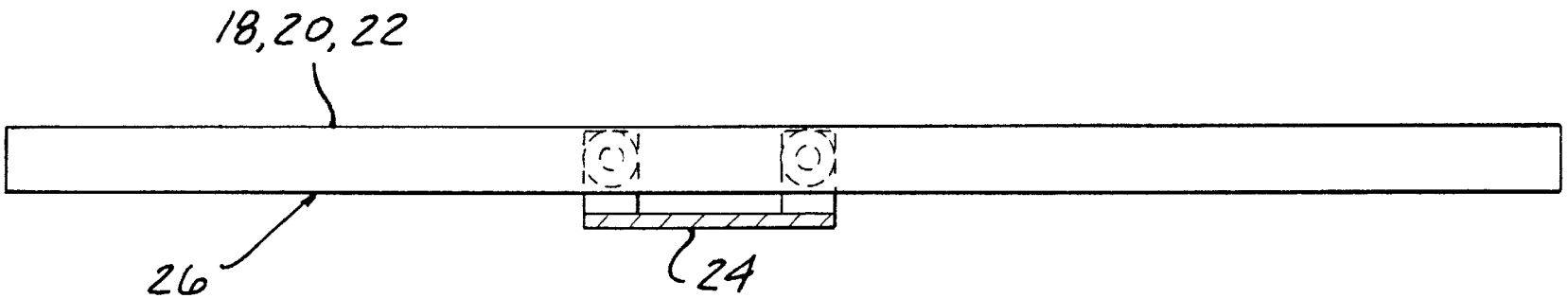
FIG. 3 is a side elevational view of a track and guide assembly according to the present invention.
Figure 5:
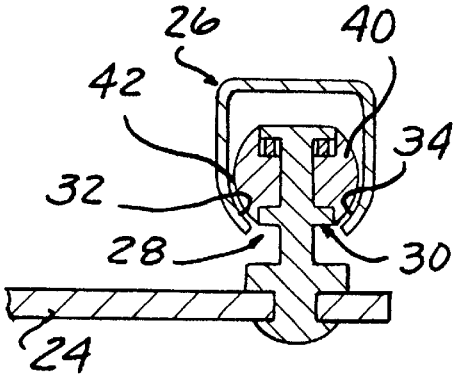
FIG. 5 is a cross-sectional detail view of a guide member including a slide engaging an interior surface of the track according to the present invention.

Alternatively, or additionally, the guide member 30 can include at least one slide 40 engageable within each corresponding track 18, 20, 22 as illustrated in FIG. 5. Each of the slides 40 has a track engaging surface 42 in sliding contact with an interior surface of the track, such as the first and second guide-engaging surfaces 32, 34 of the corresponding track 18, 20, 22. Each bracket 24 supports at least one guide member 30 within the corresponding track 18, 20, 22. Each bracket 24 can support a single roller 36, or a single slide 40, or a plurality of rollers 36, or a plurality of slides 40, or any combination thereof. In the preferred embodiment, each bracket 24 includes at least two guide members 30 as illustrated in FIGS. 2 and 3. Preferably, at least one of the guide members 30 is a roller 36. Each bracket 24 preferably supports two guide members, such as a roller 36 and a slide 40, in spaced longitudinal positions with respect to one another. In operation, the spaced longitudinal positions of the two guide members 30 permit the bracket to pass through the non-linear portion of the fixed path, such as that shown for illustration purposes in FIG. 1 and FIG. 2.

Figure 6:
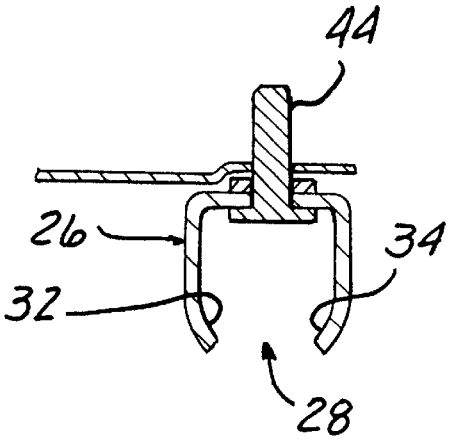
FIG. 6 is a cross-sectional detail view of a track with attachment means passing through the upper surface according to the present invention.
Figure 7:
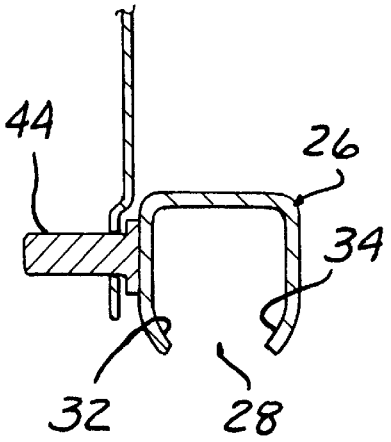
FIG. 7 is a cross-sectional detail view of a track with attachment means connected to one of the vertical extending sidewalls according to the present invention.

Referring now to FIGS. 6 and 7, the tracks 18, 20, 22 can be supported from the frame and body of the vehicle 10 by any suitable means. By way of example, and not limitation, a fastener 44 can be connected to or through the wall of the track 18, 20, 22 as required for attachment to the vehicle 10. The fastener 44 can be in any suitable configuration such as a bolt screw, welding stud, self-anchoring pin, or the like.

In operation, the present invention provides an apparatus for suspending and guiding a movable door panel or sliding door 16 through a non-linear path for opening and closing an opening in a motor vehicle 10. The bracket 24 is connectable to the sliding door 16 and supports at least one guide element 30 within the interior of a corresponding track. At least one elongate non-linear track is connectible to the motor vehicle 10. The track has a generally C-shaped cross-section 26 with an elongate slot 28 opening downwardly through the track. The track includes first and second guide-engaging surfaces 32, 34 on an inner surface of the track with the elongate slot 28 disposed between the first and second guide-engaging surfaces 32, 34. In the preferred configuration, an upper track 18, intermediate track 20, and lower track 22 are provided with identical generally C-shaped cross-section 26. Each track 18, 20, 22 is connected to the vehicle 10 in a generally horizontal orientation. The guide member preferably includes at least one load bearing roller 36 having a horizontal axis of rotation transverse to a longitudinal axis of the corresponding elongate track 18, 20, 22. As the sliding door 16 is moved between the open position and the closed position in either direction, the roller 36 rotates about the horizontal axis of rotation with a track-engaging surface 38 in rolling contact with the first and second guide-engaging surfaces 32, 34. Alternatively, or additionally, the guide member 30 can also include a non-load bearing slide or a load bearing slide 40 connected to the bracket 24 and positioned within the interior of the corresponding track 18, 20, 22. The slide 40 includes track-engaging surface 42 which can engage the first and second guide-engaging surfaces 32, 34 in sliding engagement as the sliding door 16 moves in either direction between the open position and the closed position. Preferably, at least two guide members are connected to each bracket 24.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a sliding door for a vehicle having an opening in at least one side thereof, the sliding door connected to the vehicle for non-linear movement along a fixed path between an open position and a closed position with respect to the opening, the fixed path defined by an upper guide track, a lower guide track and an intermediate guide track, the improvement comprising:

each elongate guide track having an identical generally C-shaped cross-section with an elongate slot opening through a lower surface; and at least one spherical guide member engageable within each track for guiding the sliding door while moving between the open position and the closed position with respect to the opening in the vehicle, wherein the at least one spherical guide member includes at least one spherical roller engageable within each track and having a horizontal axis of rotation, each of said rollers having a track-engaging surface in rolling contact with an interior surface of the track.

2. The improvement of claim 1 further comprising:

each spherical roller having the horizontal axis of rotation extending transverse to a longitudinal axis of the elongate track.

3. The improvement of claim 1 wherein said at least one guide member further comprises:

at least one spherical slide engageable within each track, each of said slides having a track-engaging surface in sliding contact with an interior surface of the track.

4. The improvement of claim 1 wherein each identical elongate track is adapted to be disposed horizontally on the vehicle.

5. The improvement of claim 1 further comprising:

a bracket adapted to be connected to the door for each track, each bracket supporting the at least one guide member within the track.

6. The improvement of claim 5 further comprising:

each bracket supporting a spherical roller and a spherical slide.

7. The improvement of claim 5 further comprising:

each bracket supporting two spherical rollers spaced from one another.

8. The improvement of claim 5 further comprising:

each bracket supporting two spherical slides spaced from one another.

9. The improvement of claim 1 further comprising:

each track having first and second guide-engaging surfaces on inner surfaces of the track to define the elongate slot extending between the first and second guide-engaging surfaces.

10. An apparatus for suspending and guiding a moveable door panel through a non-linear path for opening and closing an opening in a motor vehicle comprising:

a bracket connectible to the movable door panel;

at least one elongate non-linear track connectible to the motor vehicle, the track having a generally C-shaped cross-section with an elongate slot opening downwardly through the track, the track having first and second guide-engaging surfaces on inner surfaces of the track to define the elongate slot extending between the first and second guide-engaging surfaces; and at least one spherical guide element attached to the moveable door panel by the bracket, the guide element operable in cooperating engagement with the first and second guide-engaging surfaces of the elongate track, wherein the guide element includes two spherical rollers support by the bracket spaced from one another.

11. The apparatus of claim 10 wherein the at least one elongate non-linear track further comprises:

an upper track, an intermediate track, and a lower track.

12. The apparatus of claim 11 further comprising:

each track connected to the vehicle in a horizontal orientation.

13. An apparatus for suspending and guiding a moveable door panel through a non-linear path for opening and closing an opening in a motor vehicle comprising:

a bracket connectible to the movable door panel;

at least one elongate non-linear track connectible to the motor vehicle, the track having a generally C-shaped cross-section with an elongate slot opening downwardly through the track, the track having first and second guide-engaging surfaces on inner surfaces of the track to define the elongate slot extending between the first and second guide-engaging surfaces, wherein the at least one elongate non-linear track includes an upper track, an intermediate track, and a lower track, each track having an identical generally C-shaped cross-section with an elongate slot defining a vertically downwardly facing opening; and at least one spherical guide element attached to the moveable door panel by the bracket, the guide element operable in cooperating engagement with the first and second guide-engaging surfaces of the elongate track.

14. The apparatus of claim 13, wherein the guide element further comprises:

at least one spherical slide engageable within each track, each of said slides having a track-engaging surface in sliding contact with an interior surface of the track.

15. The apparatus of claim 13 wherein the guide element further comprises:

a spherical roller and a spherical slide supported by each bracket.

16. The apparatus of claim 13 further comprising:

the at least one spherical guide member including at least one spherical roller engageable within each track and having a horizontal axis of rotation, each of said rollers having track-engaging surfaces in rolling contact with the first and second guide-engaging surfaces of the track straddling the elongate slot.

17. An apparatus for suspending and guiding a moveable door panel through a non-linear path for opening and closing an opening in a motor vehicle comprising:

a bracket connectible to the movable door panel;

at least one elongate non-linear track connectible to the motor vehicle, the track having a generally C-shaped cross-section with an elongate slot opening downwardly through the track, the track having first and second guide-engaging surfaces on inner surfaces of the track to define the elongate slot extending between the first and second guide-engaging surfaces; and at least one spherical guide element attached to the moveable door panel by the bracket, the guide element operable in cooperating engagement with the first and second guide-engaging surfaces of the elongate track, wherein the guide element includes two spherical slides supported by the bracket spaced from one another.

18. The apparatus of claim 13 wherein the guide element further comprises:

a spherical roller having a horizontal axis of rotation transverse to a longitudinal axis of the elongate track.

19. The apparatus of claim 13 wherein the guide element further comprises:

a spherical roller supported by each bracket.

* * * * *